US006045054A

United States Patent [19]

Peterson, Jr.

[11] Patent Number: 6,045,054

[45] Date of Patent: Apr. 4, 2000

[54] AIR SHROUD FOR AIR ASSIST FUEL INJECTOR

[75] Inventor: William A. Peterson, Jr., Smithfield, Va.

[73] Assignee: Siemens Automotive Corporation, Auburn Hills, Mich.

[21] Appl. No.: 09/065,372

[22] Filed: Apr. 23, 1998

[51] Int. Cl.[7] ..... F02D 1/06

[52] U.S. Cl. ..... 239/5; 239/409; 239/585.1

[58] Field of Search ..... 239/290, 423, 239/407, 416.5, 417.3, 585.1–585.5, 408–410, 5

[56] References Cited

U.S. PATENT DOCUMENTS

| | | | |
|---|---|---|---|
| 3,684,186 | 8/1972 | Helmrich . | |
| 4,821,963 | 4/1989 | Arnout et al. . | |
| 5,174,505 | 12/1992 | Shen | 239/417.3 |
| 5,193,743 | 3/1993 | Romann et al. | 239/417.3 |
| 5,315,973 | 5/1994 | Hill et al. . | |
| 5,323,966 | 6/1994 | Buchholz et al. | 239/585.4 |
| 5,365,902 | 11/1994 | Hsu . | |
| 5,395,050 | 3/1995 | Nowak et al. | 239/417.3 |
| 5,533,481 | 7/1996 | Kronberger . | |
| 5,556,034 | 9/1996 | Sakakida et al. | 239/417.3 |
| 5,577,666 | 11/1996 | Shen . | |
| 5,680,992 | 10/1997 | Grytz et al. | 239/408 |
| 5,704,551 | 1/1998 | Schmidt et al. | 239/424.5 |
| 5,713,327 | 2/1998 | Tilton et al. . | |
| 5,826,804 | 10/1998 | Reiter et al. | 239/417.3 |

*Primary Examiner*—Andres Kashnikow
*Assistant Examiner*—Dinh Q. Nguyen

[57] ABSTRACT

A fuel injector for a spark ignition internal combustion engine includes a fuel injector having inlet and discharge ends. The discharge end includes a fuel injection port for supplying a fuel stream directed along an axis. An air shroud supplies assist air. The air shroud includes a first end mountable over the injector discharge end. The air shroud also includes a second end having an air assist passageway coaxially aligned with the fuel injection port for directing the fuel stream through the passageway along a common axis and guiding a flow of assist air through the passageway. The air flowing through the passageway coaxially surrounds the fuel stream to mix with the fuel upon discharge from the passageway, thereby providing a precisely targeted atomized fuel spray.

6 Claims, 2 Drawing Sheets

AIR SHROUD FOR AIR ASSIST FUEL INJECTOR

FIELD OF THE INVENTION

This invention relates to fuel injectors for spark-ignition, internal combustion engines and more particularly to an air assist fuel injector.

BACKGROUND OF THE INVENTION

The function of air assist fuel injectors is to provide enhanced atomization so that exhaust emissions can be minimized through more complete combustion. Prior designs, while providing better atomization, have failed to maintain accurate fuel spray targeting.

Fuel which wets the intake port impairs both emissions and driveability as the fuel film causes acceleration driving modes to be lean and decelerations to be rich. This problem is aggravated during cold engine conditions as the fuel film thickness is inversely related to port wall temperature. (The first two minutes of the cold engine phase of the emission test accounts for most of the emissions as the catalyst initially has zero conversion efficiency and tailpipe emissions are strongly dependent upon the raw emissions from the engine.)

While there are algorithms which compensate for this rich/lean condition, the finely atomized fuel which hits the port walls is not finely atomized when it flashes off the walls and/or runs down the walls. Thus much of the benefit is lost.

Known air assist fuel injectors for distributing fuel from a fuel injection valve in the vicinity of an intake port to two intake valves in a combustion chamber utilize a sleeve nozzle having fuel flow separating holes provided on the fuel injection downstream side of a fuel injection port means to separate a spray of fuel jetted from the fuel injection port means into flows in a plurality of different directions. The sleeve nozzle also has a plurality of slit-like air holes for jetting assist air in a band-like manner such that the assist air impinges against fuel sprays separately jetted from the fuel flow separating holes from the opposite sides of the fuel sprays. With this arrangement, flat jets of air impinge obliquely against the jetted fuel. With such an arrangement, the fuel cannot be directly targeted as a well defined spray.

SUMMARY OF THE INVENTION

The present invention provides an air assist fuel injector that introduces an air assist airflow coaxial to an axially directed fuel stream. The co-axial air/fuel flow allows for precise targeting of the resulting spray pattern.

The invention provides a fuel injector for a spark ignition internal combustion engine including a fuel injector having inlet and discharge ends. The discharge end includes a fuel injection port for supplying a fuel stream directed along an axis. An air shroud supplies assist air. The air shroud includes a first end mountable over the injector discharge end. The air shroud also includes a second end having an air assist passageway coaxially aligned with the fuel injection port for directing the fuel stream through the passageway along a Common axis and guiding a flow of assist air through the passageway. The air flowing through the passageway coaxially surrounds the fuel stream to mix with the fuel upon discharge from the passageway thereby providing a precisely targeted atomized fuel spray.

The air shroud is of a cup like shape having a generally cylindrical sidewall extending from the second end. The second end has an inside surface spaced from the injector discharge end allowing air to be directed therebetween. The injector discharge end includes an orifice plate including the fuel injection port.

Optionally the orifice plate includes multiple injection ports and the shroud second end includes a corresponding multiple of air assist passageways.

The invention also provides a method of delivering an air fuel mixture in a fuel injected spark ignition engine having a fuel injector including inlet and discharge ends. The method includes the steps of providing a fuel injection port in the discharge end of the fuel injector for supplying a fuel stream directed along an axis. An air shroud is provided having an air assist passageway coaxially aligned with the fuel injection port for supplying assist air. A fuel stream is directed through the passageway along the common axis and the air flow of assist air is guided through the passageway and coaxially surround the fuel stream to mix with the fuel upon discharge from the passageway thereby providing a precisely targeted atomized fuel spray.

These and other features and advantages of the invention will be more fully understood from the following detailed description of the invention taken together with the accompanying drawings.

DETAILED DESCRIPTION OF THE INVENTION

Figure 1:
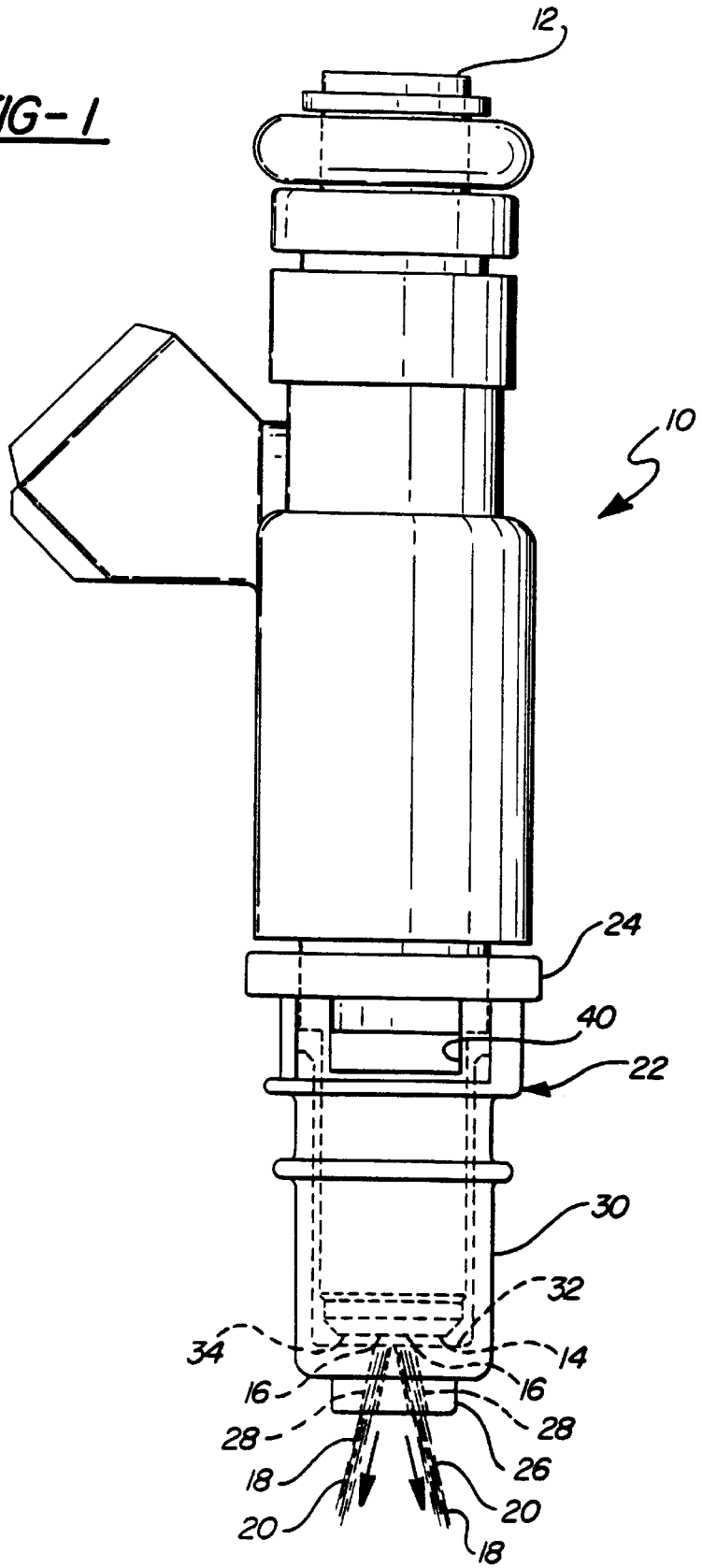
FIG. 1 is a side view of a fuel injector constructed in accordance with the present invention illustrating its discharge end and an air shroud mounted thereon.
Figure 2:
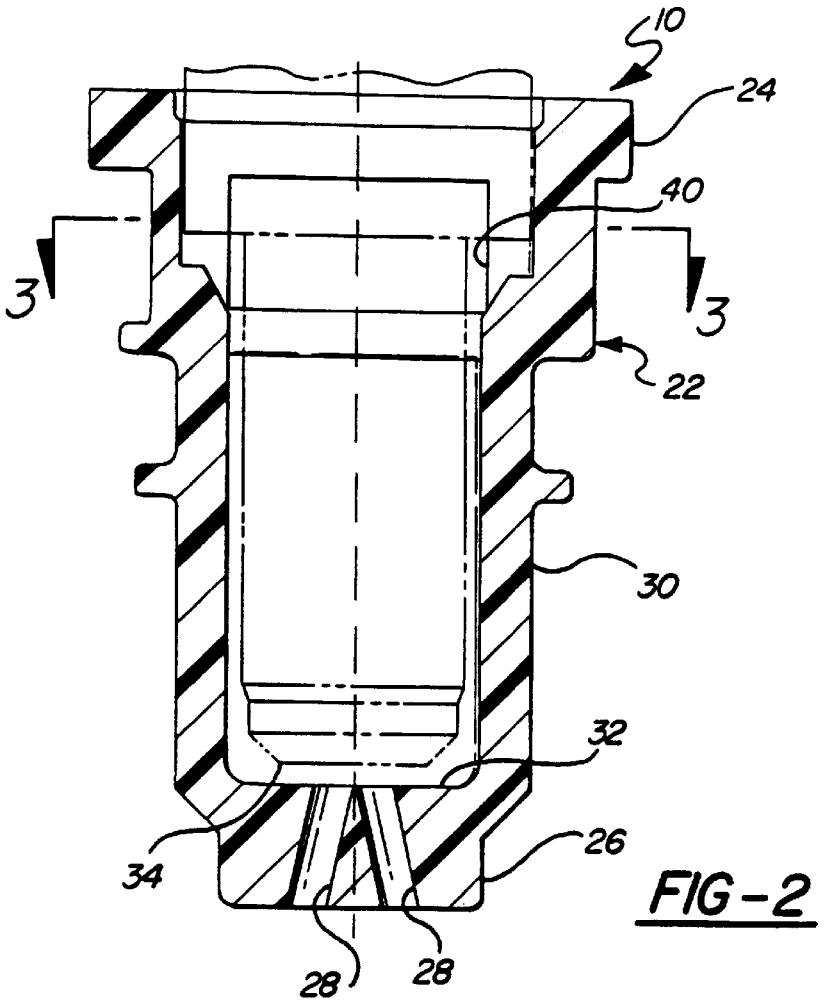
FIG. 2 is an enlarged cross sectional view of the air shroud mounted on the discharge end of the fuel injector of FIG. 1.
Figure 3:
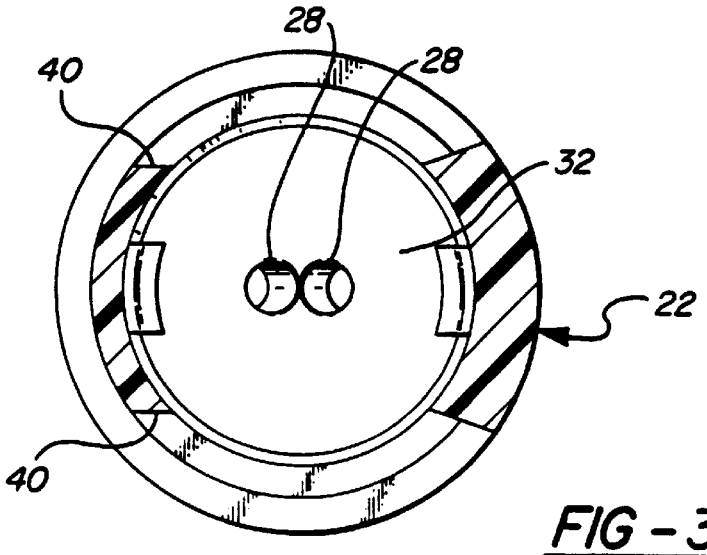
FIG. 3 is an enlarged cross sectional view of the shroud looking downward from the line 3—3 of FIG. 2.

Referring to FIGS. 1–3, there is shown a fuel injector 10 for a spark ignition internal combustion engine, not shown, used to supply an atomized fuel spray into an internal combustion engine. As is hereinafter more fully described, the fuel injector 10 provides a precisely targeted atomized fuel spray.

Referring to FIG. 1 the fuel injector 10 includes inlet and discharge ends 12, 14. The discharge end 14, includes a fuel injection port 16 for supplying a fuel stream 18 directed along an axis 20. Fuel injector 10 includes an air shroud 22 for supplying assist air. Air shroud 22 includes a first end 24 mountable over the injector discharge end 14. The air shroud also includes a second end 26 having an air assist passageway 28 coaxially aligned with the fuel injection port 16 for directing the fuel stream 18 through the passageway along a common axis. Air assist passageway 28 also guides a flow of assist air through the passageway so that the air coaxially surrounds the fuel stream 18 to mix with the fuel upon discharge from the passageway. The fuel and air discharged from the air assist passageway 28 becomes a precisely targeted atomized fuel spray.

With further reference to the drawings, air shroud 22 is of a cup shape having a generally cylindrical sidewall 30 extending from the second end 26. The second end 26 has an inside surface 32 spaced from the injector discharge end 14 allowing air to be directed therebetween.

The discharge end 14 of the fuel injector 10 includes an orifice plate 34 including the fuel injection port 16.

In the embodiment illustrated, orifice plate 34 includes two injection ports 16 for supplying separate fuel streams 18 directed along axes 20. In other applications where the invention is used there are more than two fuel streams having a coaxially aligned air assist flow.

Shroud 22 includes a corresponding multiple, two, of air assist passageways 28 extending through the second end 26 of the shroud.

With this arrangement, the assist air is coaxially aligned and directed with the fuel streams jetted from the injection ports of the orifice plate 34. The fuel stream is coaxially surrounded by the assist air, thereby allowing the atomized fuel spray to be precisely targeted.

Turning now to the method of delivering an air fuel mixture in a fuel injected spark ignition engine, not shown, having a fuel injector including inlet and discharge ends, the method includes the steps of providing a fuel injection port in the discharge end of the fuel injector for supplying a fuel stream directed along an axis. An air shroud is provided having an air assist passageway coaxially aligned with the fuel injection port for supplying assist air. A fuel stream is directed and/or jetted through the passageway along a common axis and the assist air flow is guided through the passageway coaxially surrounding the fuel stream to mix with the fuel stream upon discharge from the passageway. Thus the method of delivering the air fuel mixture provides an atomized spray that is precisely targeted.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A fuel injector for a spark-ignition, internal combustion engine, comprising:

an inlet end;

a discharge end including a fuel injection port that supplies a fuel stream directed along a longitudinal axis;

a fuel passageway between the inlet and discharge ends; and an air shroud that supplies assist air, the air shroud having: a first end mountable over the discharge end, and a second end having an inside surface that is spaced from the discharge end to allow the assist air to be directed therebetween, and an air assist passageway coaxially aligned with the longitudinal axis for directing the assist air substantially in a fuel discharge direction so that the assist air engages a flow of the fuel stream through the air assist passageway along a common axis and for guiding a flow of assist air through the air assist passageway such that the assist air coaxially surrounds the fuel stream to mix with the fuel upon discharge from the air assist passageway, thereby providing a precisely targeted atomized fuel spray.

2. A fuel injector as in claim 1, wherein the air shroud is of a cup shape having a generally cylindrical sidewall extending from the second end.

3. A fuel injector as in claim 2 wherein said injector discharge end includes an orifice plate including said fuel injection port.

4. A fuel injector as in claim 3 wherein said orifice plate includes multiple injection ports.

5. A fuel injector as in claim 4 wherein said shroud second end includes a corresponding multiple of air assist passageways.

6. A method of delivering an air fuel mixture in a fuel injected spark ignition engine having a fuel injector including an inlet end, a discharge end, and a fuel passageway therebetween, the method comprising the steps of:

providing a fuel injection port in the discharge end that supplies a fuel stream directed along a longitudinal axis;

providing an air shroud that supplies assist air, wherein the air shroud has an air assist passageway that is coaxially aligned with the longitudinal axis;

directing the assist air substantially in a fuel discharge direction so that the assist air engages a flow of the fuel stream through the air assist passageway along a common axis; and guiding flow of the assist air through the air assist passageway such that the assist air coaxially surrounds the fuel stream to mix with the fuel upon discharge from the air assist passageway;

thereby providing a precisely targeted atomized fuel spray.

* * * * *